United States Patent [19]

Wiholm

[11] Patent Number: 4,678,386

[45] Date of Patent: Jul. 7, 1987

[54] THERMAL SHEET BINDING APPARATUS AND A METHOD FOR BINDING OF LOOSE SHEETS IN A FOLDER

[75] Inventor: Sture H. Wiholm, Johanneshov, Sweden

[73] Assignee: Bind-O-Matic AB, Stockholm, Sweden

[21] Appl. No.: 885,390

[22] Filed: Jul. 17, 1986

Related U.S. Application Data

[63] Continuation of Ser. No. 752,507, Jul. 5, 1985, abandoned.

[51] Int. Cl.[4] ..... B42C 19/00

[52] U.S. Cl. ..... 412/8; 156/360; 412/11; 412/13; 412/900; 412/902

[58] Field of Search ..... 412/8, 11, 13, 14, 37, 412/900, 902; 156/359, 360; 219/243, 503, 504

[56] References Cited

U.S. PATENT DOCUMENTS

| | | | |
|---|---|---|---|
| 3,437,506 | 4/1969 | Falberg | 412/900 |
| 4,108,713 | 8/1978 | Weisz | 412/900 |
| 4,141,100 | 2/1979 | Domroe et al. | 412/37 |
| 4,150,453 | 4/1979 | Vaughn | 412/900 |
| 4,178,201 | 12/1979 | Power et al. | 412/900 |
| 4,367,116 | 1/1983 | Wiholm | 412/8 |

FOREIGN PATENT DOCUMENTS

| | | | |
|---|---|---|---|
| 2144080 | 2/1985 | United Kingdom | 412/8 |

*Primary Examiner*—Howard N. Goldberg
*Assistant Examiner*—Taylor J. Ross
*Attorney, Agent, or Firm*—Dressler, Goldsmith, Shore, Sutker & Milnamow, Ltd.

[57] ABSTRACT

A sheet binding apparatus, for attaching loose sheets to one or more folders, has a completely automatic binding process after insertion of the folder(s). This is carried out by a heating assembly, the current supply to which is controlled by a micro-processor having inputs received from a starter device of light detector type, a temperature detector device of thermistor type and a timer device. The timer device is activated by the micro-processor when the temperature detector device indicates working temperature at the heating assembly. In one aspect of the binding process it is also related to the thickness of the folder(s) to be bound. This is carried out by a current control device acting on the supply circuit for the heating assembly in such a way that the thicker the folders inserted, the more current is allowed to the heating assembly.

8 Claims, 5 Drawing Figures

THERMAL SHEET BINDING APPARATUS AND A METHOD FOR BINDING OF LOOSE SHEETS IN A FOLDER

This application is a continuation, of application Ser. No. 752,507, filed July 5, 1985, now abandoned.

BACKGROUND OF THE INVENTION

1. Field of the Invention

The present invention relates to an improved sheet binding apparatus and particularly to a thermal sheet binding apparatus for simultaneously binding sheets in one or more folders provided with a heat-sensitive binding agent. Furthermore, the present invention relates to a method for an automatic binding process having no requirement for manually operated temperature and time intervals.

2. Description of the Prior Art

To avoid some drawbacks with older binding techniques, such as uncertainty in judging the length of time to be set for obtaining proper binding, a new technique was presented by the present applicant through his U.S. Pat. No. 4,367,116 "Binding Apparatus". By the new technique the heating element is continuously heated for maintaining a desired working temperature. Since the binding apparatus presented was designed to take care of folders of different thickness by having an adjustable opening, there was a demand for different operation times dependent on the actual binder or folder thickness. This was solved by having a set of buttons for presetting of the operating time.

The binding apparatus according to the U.S. patent mentioned is simple to operate but has an undesirable energy consumption. Though the operation is simple it would be better if one could also avoid the time presetting operation. These targets are obtained by the present invention.

SUMMARY OF THE INVENTION

According to one aspect of the present invention, an improved sheet binding apparatus comprises a housing having a heating assembly supported therein below an opening, the width thereof being restricted by a front support means and a rear support means. The front support means is movable to adjust the opening width with respect to the thickness of folders inserted through the opening. The top surface of the heating assembly is heated by a heating element means when the folder(s) is/are in touch with the top surface to activate a heat-sensitive binding agent provided in each folder for binding loose sheets inside the folder(s). In an electrical supply circuit feeding the heating means, there is a current control means which adjusts the current supply in relation to the total thickness of the folder or folders inserted.

By having a current control means depending on the total thickness of the folder(s) inserted, one will obtain a fixed time of binding at working temperature independent of the number of pages involved.

The current control means may be of rheostat or transformer type as well as of any other suitble type, e.g. modern semiconductor type.

According to another aspect of the present invention, an improved sheet binding apparatus comprises a housing having a heating assembly supported therein below an opening. The heating assembly has a top surface being heated by an electric heating means when folder or folders is/are inserted through the opening and in touch with the top surface to activate a heat-sensitive binding agent provided in each folder for binding loose sheets inside the folder(s). A temperature detector means in close connection to the heating assembly controls the current supply through an electrical supply circuit feeding the heating means. A timer is connected to the supply circuit to maintain the current supply for a predetermined time after the temperature of the heating assembly has reached working temperature as detected by the temperature detector.

By having a temperature detector continuously sensing the temperature of the heating assembly it is possible to compensate for different starting temperatures of the heating assembly. When the apparatus has been out of use for a longer time and the heating assembly is down to room temperature, the detector signal may be used to have an accelerated power supply, i.e. a current supply to the heating means above normal. When the desired working temperature is obtained the detector signal is used to switch the current supply to a level maintaining the working temperature and to start the timer for having the current supply terminated after a predetermined time. If the apparatus is restarted after a shorter while, the heating assembly may have a temperature above the room temperature and there is no need for an accelerated current supply. This may be determined by the detector signal.

The detector means may favourably comprise a thermistor in mechanical contact with the heating assembly and in electrical connection with a microprocessor having also an input connected to a starter device activated by folder insertion. The current supply to the heating means is controlled through the microprocessor output.

The starter device is favourably of the light beam type as in the U.S. patent mentioned above.

A most favourble function is obtained by combining the two aspects referred to above. Thus, the present invention also involves a method for binding of loose sheets in one or more folders. The method is characterized by the following steps:

(a) one or more folders, each one including some loose sheets to be fixed to the folder, is/are inserted in the apparatus in touch with a heating assembly thereby breaking a light beam detected by a photocell;

(b) a start signal produced by said photocell is sent to a micro-processor to close a power supply circuit to a heating element means of said heating assembly;

(c) the current from the power supply is controlled through a rheostate, the position of which is independent on the thickness of folders inserted;

(d) a temperature indication signal generated by a thermistor in close connection to said heating assembly is connected to the micro-processor for starting a timer when the heating assembly reaches the working temperature, said timer being set for a predetermined time;

(e) an interruption signal obtained from the timer at the end of the predetermined time period is sent to said micro-processor to open the power supply circuit; and (f) the folder(s) with the sheets now fixed thereto may then be removed whenever wanted.

Favourably the working temperature is about 150° C. and the predetermined time about 30–40 seconds, depending on from which temperature the preheating up to working temperature is started.

As is made clear above the sheet binding apparatus according to the present invention has a heating power supply started by insertion of folder and stopped after a predetermined time counted from obtained working temperature. This results in good energy saving without waiving the advantages obtained by the binding apparatus of the U.S. patent mentioned above. Furthermore, still another advantage is to be seen in full automation obtained independent of thickness of folders inserted. Thus, all hand operated settings are avoided.

BRIEF DESCRIPTION OF THE DRAWINGS

These and other objects, features and advantages of the present invention will become more readily understood when considered in connection with a presently preferred, but nevertheless illustrative, embodiment of the invention as explained in the following detailed description as shown in the accompanying drawings, wherein.

DETAILED DESCRIPTION OF THE PREFERRED EMBODIMENT

Figure 1:
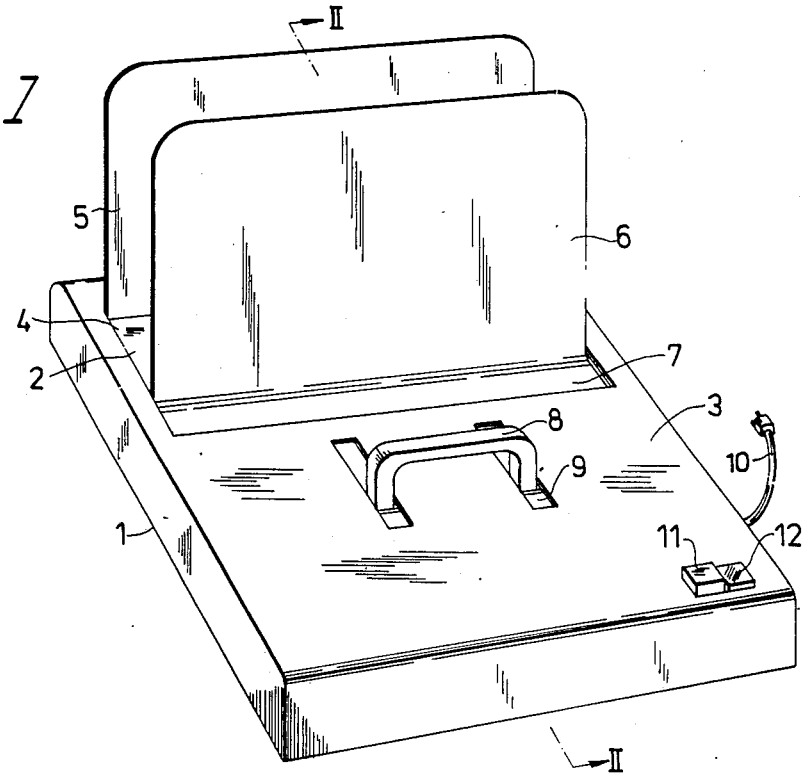
FIG. 1 is a perspective view of a sheet binding apparatus in accordance with the invention.

As will be seen from FIG. 1 the inventive sheet binding apparatus has a cover 1 surrounding a heat assembly 2. The cover 1 has a table surface 3, in the back portion of which an opening 4 is made to enable one or more folders to be inserted and come into contact with the heating assembly 2. At its back edge, the opening 4 is defined by a fixed rear support means 5 and at its front opposing edge by a displaceable front support means 6. The displaceable support means 6 is bent so as to have a portion 7 which is in the immediate vicinity of the underside of the table surface 3. The part 7 of the support means 6 has a handle 8 which projects up above the table surface 3 through slots 9 made therein. In the table surface 3 there may also be openings for a main switch 11 and a signal lamp 12. A line cord 10 to be connected to the voltage source is entering the cover 1 at one side.

Figure 2:
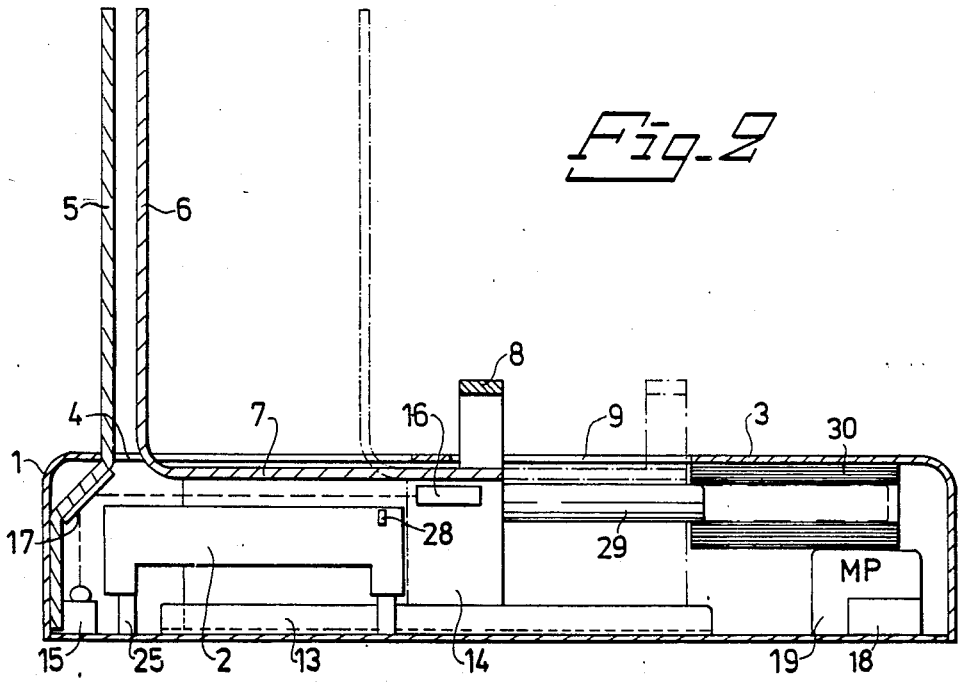
FIG. 2 is a section along the line II—II in FIG. 1.

FIG. 2 is a section along the line II—II in FIG. 1, wherein the displaceable front support means 6 is illustrated in two different positions, the chain dotted position being that which gives the greatest opening 4, and thereby room for the thickest folder or file which can be bound, or for the greatest number of thinner folders which can be bound at one time. A pair of rails 13 are attached to the bottom of the cover 1 for carrying the displaceable support means 6. At its bent portion 7 the latter has two parallel flanges 14 intended for gliding in the rails 13, for which purpose the edges of the flanges 14 are covered with low friction material, e.g. Teflon tape.

The cover bottom also carries the heating assembly 2, which will be more closely described in conjunction with FIG. 3 below.

A light source 15 is further arranged on the bottom of the cover to illuminate a photocell 16 via a reflector 17. The reflector 17 can be made as a blank surface on the fixed support means 5, which is then bent to a suitable angle and attached to the rear end wall of the cover 1. The photocell 16 is suitably a phototransistor connected to a micro processor (MP) 19 and attached at the side of the opening 4 facing the fixed support means 5. A thermistor 28 is in close connection with the heating assembly 2. The electrical wiring will be explained below in conjunction with FIG. 4.

Figure 5:
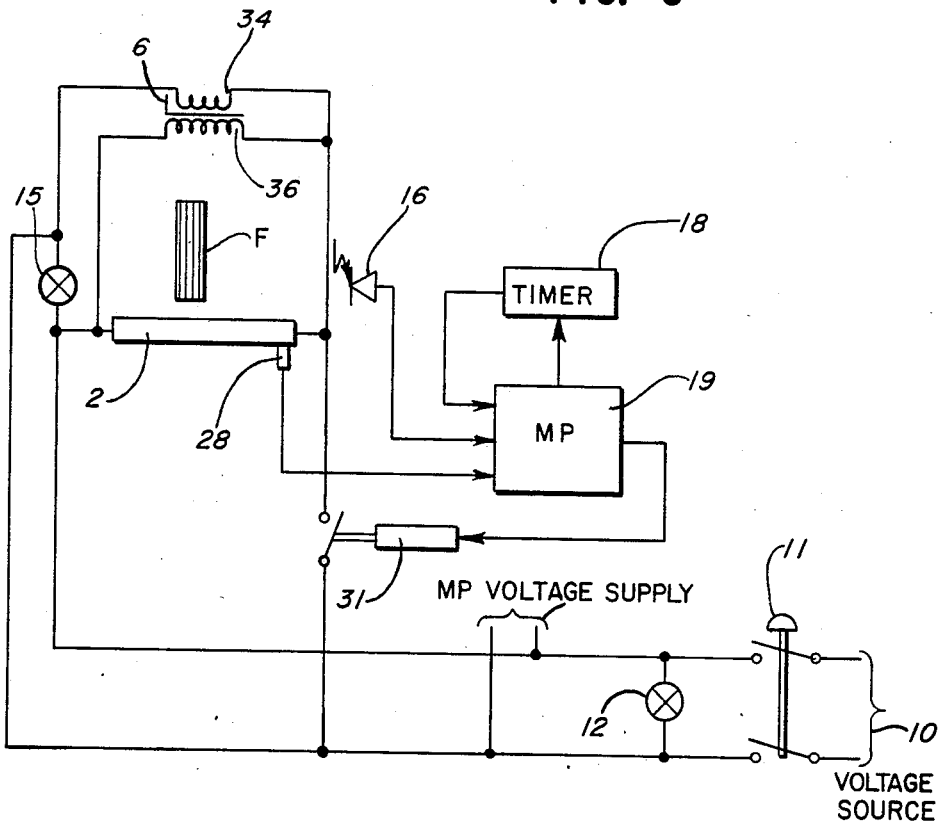
FIG. 5 is a simplified wiring diagram showing the basic principle for the functions of the sheet binding apparatus according to another embodiment of the invention.

As also will be seen from FIG. 2 there is a current control means 29, 30 for varying the current supply to the heating assembly 2 in relation to the total thickness of the folder or folders inserted through the opening 4. The current control means shown in FIG. 2 is of the type with a fixed coil 30 and a movable magnetical core 29. The core 29 is moved by the displaceable support means 6. However, the current means can be realized by other means as well, e.g. as a transformer having a fixed primary winding 24 and a movable secondary winding 36 fixed to the support means, as shown in FIG. 5. Thus, it is aimed that the greater the thickness of folders inserted, the more current has to be fed to the heating assembly 2.

Figure 3:
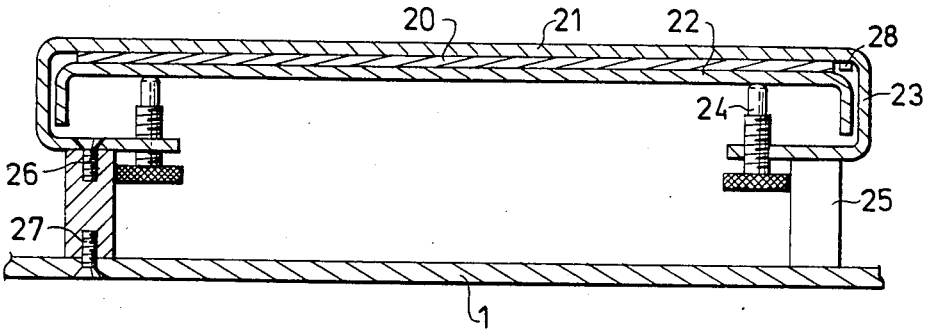
FIG. 3 is a cross-section of the heat assembly included in the sheet binding apparatus.

FIG. 3 illustrates in more detail the construction of the heating assembly 2 and its mounting. The heat assembly thus comprises a heating element 20, e.g. of foil type inserted between two surfaces 21, 22 of heat conductive material, e.g. aluminum. The upper surface 21 constitutes the support surface of the heating assembly 2, against which the folder which is to be bound will engage. The lower surface 22 forms a pressure pad intended to urge the heating element 20 into intimate contact with the underside of the support surface 21. This is achieved by the support surface 21 being formed with flanges 23 in which there are threaded holes for screws 24. The ends of the screws 24 act on the pad 22, either directly on its underside or on flanges which are formed on the pad 22 in correspondance to the flanges 23 of the support surface. The thermistor 28 is shown laying between the two surfaces 21 and 22.

The heating assembly 2 is mounted on the bottom of the cover 1 with the aid of bushings 25 which are attached to the flanges 23 of the support surface 21 and the bottom of the cover 1. The attachment is preferably made using blind screws 26, 27.

The function of the binding apparatus ensures that it maintains a condition of readiness, i.e. at the beginning of the workday the apparatus is started by operating the main switch 11. As is evident from FIG. 4 when switching on, the signal lamp 12 is lit up and the light source 15 is put into operation. Also, the microprocessor 19 will be energized. When one or more folders F are to be bound the apparatus is thus ready for operation. The folders F can be of the type shown in FIG. 4 of the U.S. Pat. No. 4,367,116.

When the operator will make a binding he has only to insert the folder (or if more than one, the folders) F. There is no need for any preselection of binding time or temperature.

Figure 4:
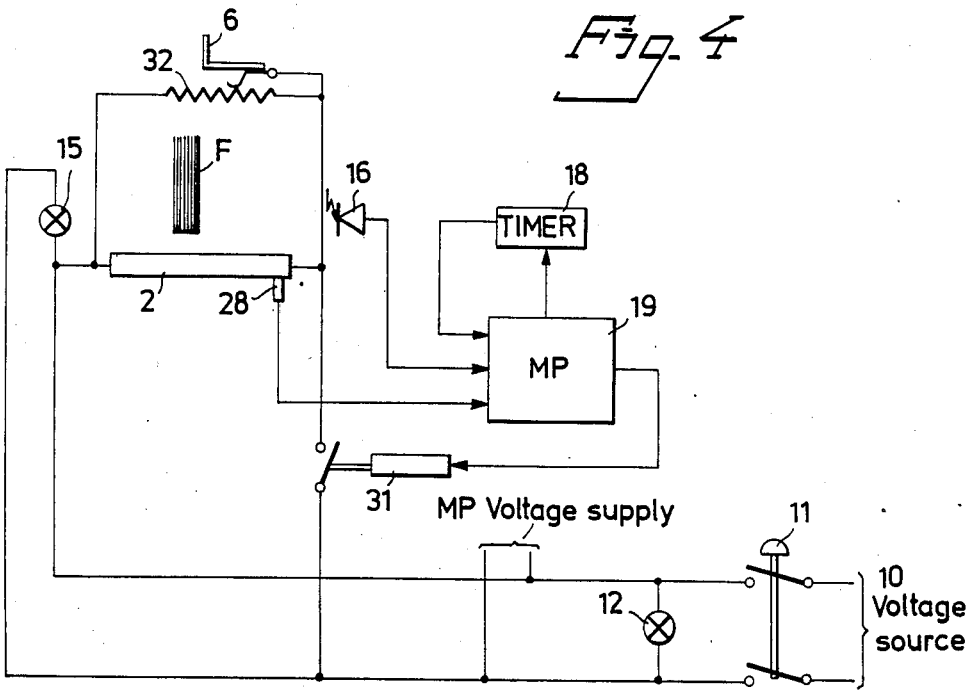
FIG. 4 is a simplified wiring diagram showing the basic principle for the function of the sheet binding apparatus according to another embodiment of the invention.

Insertion of a folder F interrupts the light beam from light source 15 and the photocell 16 generates a start signal feed to the micro-processor 19. This start signal activates the micro-processor 19 to close the supply circuit through a relay 31. The current supply to the heating assembly 2 is dependent on the thickness of the folders F inserted. In FIG. 4 this is exemplified by a rheostat device 32 electrically in parallel with the heating element means of the heating assembly 2. The rheostat device 32 can be more or less short-circuited by a tap contact moved by the displaceable support means 6.

The temperature of the heating assembly 2 is continuously detected by the thermistor 28 feeding an indication signal to the micro-processor 19. The indication signal can be used by the micro-processor 19 in different ways and for different purposes, e.g. if the temperature of the heating assembly 2 is below a certain threshold value, say below 40° C., the indication signal is used by the micro-processor 19 to switch the heating element means of the heating assembly 2 for accelerated heating. Another use of the indication signal is that when the working temperature, say 150° C., is reached at the heating assembly 2 a timer 18 is started.

The timer 18 may count down from different values depending on if the heating is started from a lower temperature, say below 40° C., or if the heating is restarted from a higher temperature. However, the timer 18 counting period is set to be either 30 or 40 seconds. At the end of the timer 18 period an interruption signal is fed to the micro-processor 19. This signal causes the micro-processor to open the supply circuit through the relay 31. Then the heating assembly 2 is unsupplied and the folder(s) F can be left in the apparatus and removed whenever wanted. A new binding process cannot be started until the light beam from the light source 15 once again hits the photocell 16 and then is again interrupted by a folder F.

Even though the sheet binding apparatus above has been described in detail in conjunction with a preferred embodiment, this must not be regarded as restricting the invention. For example, all the "mechanical" control means like the relay 31 and the current control means 29, 30 or 32, may be performed in semiconductor technique as well. The timer 18, shown as a separate means, may well be incorporated in the micro-processor 19 as a part of a chip forming the whole micro-processor. Other modifications of the sheet binding apparatus are also conceivable within the scope of the invention.

What is claimed as new and desired to be secured by Letters Patent of the United States

1. A sheet binding apparatus comprising a housing;

a heating assembly supported in the housing;

an opening in the housing above said heating assembly for insertion of one or more folders;

a front support means and a rear support means restricting the width of said opening, said front support means being movable to adjust the opening width with respect to the number and/or thickness of folders inserted;

an electric heating element means included in said heating assembly;

a top surface of said heating assembly being heated by said heating means when said folder or folders is/are in touch with the top surface to activate a heat-sensitive binding agent provided in each folder for binding loose sheets inside the folder(s);

an electric supply circuit feeding said heating means, and an electrical transformer having a movable yoke and means mechanically connecting said yoke to said front support means included in the electric supply circuit and being dependent on the opening width to adjust the current supplied to the heating means in relation to the total thickness of the folder or folders inserted.

2. A sheet binding apparatus comprising a housing;

a heating assembly supported in the housing;

an opening in the housing above said heating assembly for insertion of one or more folders;

a front support means and a rear support means restricting the width of said opening, said front support means being movable to adjust the opening width with respect to the number and/or thickness of folders inserted;

an electric heating element means included in said heating assembly;

a top surface of said heating assembly being heated by said heating means when said folder or folders is/are in touch with the top surface to activate a heat-sensitive binding agent provided in each folder for binding loose sheets inside the folder(s);

an electric supply circuit feeding said heating means, and an electrical transformer the primary winding of which is electrically connected to a power supply and the secondary winding of the transformer being electrically connected to said supply circuit and means mechanically connecting said secondary winding to said front support means to be moved into or out from the primary winding by said front support means included in the electric supply circuit and being dependent on the opening width to adjust the current supplied to the heating means in relation to the total thickness of the folder or folders inserted.

3. A sheet binding apparatus comprising a housing;

a heating assembly supported in the housing;

an opening in the housing above said heating assembly for insertion of one or more folders;

a front support means and a rear support means restricting the width of said opening, said front support means being movable to adjust the opening width with respect to the thickness of folders inserted;

an electric heating element means included in said heating assembly;

a top surface of said heating assembly being heated by said heating means when said folder or folders is/are in touch with the top surface to activate a heat-sensitive binding agent provided in each folder for binding loose sheets inside the folder(s);

an electrical supply circuit feeding said heating means, and a rheostat control means included in the electrical supply circuit and being dependent on the opening width to adjust the current supplied to the heating means in relation to the total thickness of the folder or folders inserted.

4. A sheet binding apparatus comprising a housing;

a heating assembly supported in said housing;

an opening in the housing above said heating assembly for insertion of one or more folders;

an electric heating element means included in said heating assembly;

a top surface of said heating assembly being heated by said heating means when said folder or folders is/are in touch with the top surface to activate a heat-sensitive binding agent provided in each folder for binding loose sheets inside the folder;

an electrical circuit feeding said heating means;

a temperature detector means comprising a thermistor in mechanical contact with the heating assembly, a micro-processor having an input connected to said thermistor and another input connected to a starter device activated by insertion of the folder(s), said micro-processor output controlling the current supply to the heating means, and a timer connected to said supply circuit to maintain the current supply for a predetermined time after the temperature of the heating assembly has reached working temperature being detected by said temperature detector.

5. A sheet binding apparatus in accordance with claim 4 wherein said micro-processor involves the timer being of electronic circuit type.

6. A sheet binding apparatus in accordance with claim 4 wherein said starter device involves a light sensor means having light source means, the beam of which being detected by a photocell and interrupted by folder insertion.

7. A method for binding in thermal binding apparatus of loose sheets in one or more folders having a heat-sensitive binding agent, the method comprising the following steps:

(a) inserting one or more folders, each one including some loose sheets to be fixed to the folder, in the apparatus to touch with a heating assembly, thereby breaking a light beam detected by a photocell;

(b) sending a start signal produced by said photocell to a micro-processor, thereby closing a power supply circuit to a heating element means of said heating assembly;

(c) controlling the current from the power supply through a rheostat, the position of which is dependent on the thickness of folders inserted;

(d) sending temperature indication signal generated by a thermistor in close connection to said heating assembly to the micro-processor for starting a timer when the heating assembly reaches a working temperature, said timer being set for a predetermined time;

(e) sending an interruption signal obtained from the timer at the end of the predetermined time period to said micro-processor to open the power supply circuit; and (f) removing the folder(s) with the sheets now fixed thereto whenever wanted.

8. A method in accordance with claim 7 wherein said working temperature is about 150° C. and said predetermined time about 30–40 seconds.

* * * * *